US007899355B2

(12) United States Patent
Sakuma

(10) Patent No.: US 7,899,355 B2
(45) Date of Patent: Mar. 1, 2011

(54) IMAGE FORMING APPARATUS HAVING A CLEANING UNIT

(75) Inventor: Susumu Sakuma, Kasugai (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 49 days.

(21) Appl. No.: 12/410,532

(22) Filed: Mar. 25, 2009

(65) Prior Publication Data

US 2009/0285593 A1 Nov. 19, 2009

(30) Foreign Application Priority Data

May 13, 2008 (JP) ..... 2008-125755

(51) Int. Cl.
*G03G 15/01* (2006.01)
*G03G 15/16* (2006.01)
*G03G 21/10* (2006.01)

(52) U.S. Cl. ..... 399/101; 399/71; 399/112; 399/123

(58) Field of Classification Search ..... 399/101, 399/71, 112, 120, 358, 360, 123
See application file for complete search history.

(56) References Cited

U.S. PATENT DOCUMENTS 5,220,391 A 6/1993 Tange
6,708,011 B2 3/2004 Nomura et al.
2006/0067734 A1 3/2006 Igarashi et al.
2007/0147863 A1* 6/2007 Takahashi ..... 399/101 X
2008/0152378 A1* 6/2008 Yamashita et al. ..... 399/101
2009/0190955 A1 7/2009 Igarashi et al.
2009/0226205 A1* 9/2009 Sato et al. ..... 399/101

FOREIGN PATENT DOCUMENTS

JP 04-073787 A 3/1992
JP 04-284468 A 10/1992

(Continued)

OTHER PUBLICATIONS

Machine translation of JP 2007-218936 A dated Jul. 8, 2010.*

(Continued)

*Primary Examiner*—Sophia S Chen
(74) *Attorney, Agent, or Firm*—Banner & Witcoff, Ltd.

(57) ABSTRACT

An image forming apparatus includes: an image forming unit including a plurality of photoconductor drums arranged in tandem; a conveyor belt arranged opposite to the photoconductor drums and configured to convey a recording sheet; and a cleaning unit including a cleaning member positioned in contact with the conveyor belt and configured to collect substance adhering to the conveyor belt, and a receptacle configured to store the substance collected by the cleaning member. The cleaning member is arranged on the same side as the image forming unit with respect to the conveyor belt and upstream from the image forming unit as viewed in a sheet conveyance direction along which the recording sheet is conveyed on the conveyor belt, and the image forming unit and the cleaning unit are pulled out together from a main body of the image forming apparatus toward an upstream side of the sheet conveyance direction.

12 Claims, 9 Drawing Sheets

FOREIGN PATENT DOCUMENTS

| | | | | |
|---|---|---|---|---|
| JP | 06-035359 | A | | 2/1994 |
| JP | 2003-015378 | | | 1/2003 |
| JP | 2006-098772 | | | 4/2006 |
| JP | 2006-154195 | A | | 6/2006 |
| JP | 2006-171295 | A | * | 6/2006 |
| JP | 2006-276449 | A | * | 10/2006 |
| JP | 2007-218936 | | | 8/2007 |

OTHER PUBLICATIONS

JP Office Action dtd Apr. 13, 2010, JP Appln. 2008-125755, English translation.

JP Office Action dtd Nov. 16, 2010, JP Appln. 2008-125755, English translation.

* cited by examiner

IMAGE FORMING APPARATUS HAVING A CLEANING UNIT

CROSS REFERENCE TO RELATED APPLICATION

This application claims the foreign priority benefit under Title 35, United States Code, §119(a)-(d) of Japanese Patent Application No. 2008-125755 filed on May 13, 2008 in the Japan Patent Office, the disclosure of which is herein incorporated by reference in its entirety.

BACKGROUND OF THE INVENTION

The present invention relates to an image forming apparatus such as a color laser printer.

An image forming apparatus such as a laser printer is generally known, which comprises a plurality of development devices each containing different color toner, a plurality of photoconductor drums each of which is supplied with toner from a corresponding development device via a developing roller, a belt arranged opposite to the plurality of photoconductor drums, and a plurality of transfer devices configured to cause toner retained on the plurality of photoconductor drums to be attracted to the belt. In this image forming apparatus, the plurality of photoconductor drums are arranged in tandem, and a sheet of medium such as paper (hereinafter referred to as a sheet) is conveyed on the belt and passes between the plurality of photoconductor drums and the plurality of transfer devices, during which a transfer bias having the reverse polarity of the charged toner is applied to the transfer devices so that different color toner retained on the surfaces of the respective photoconductor drums is attracted by the transfer devices and continuously transferred onto the sheet to perform a color printing on the sheet.

According to this image forming apparatus, in order to ease maintenance of the photoconductor drums, each of the photoconductor drums is integrally held in a photoconductor drum unit, and this photoconductor drum unit is attached to or detached from a main body of the image forming apparatus. Further, in order to remove adhering substance such as toner and paper dust adhering to the conveyor belt due to sheet jamming, etc., the image forming apparatus is also provided with a cleaning unit configured to contact with the conveyor belt to remove and collect the adhering substance.

For example, Japanese Laid-open Patent Publication No. 2006-98772, which corresponds to US 2006/0067734 A1, discloses an image forming apparatus in which a photoconductor drum unit is arranged above a conveyor belt and a cleaning unit is arranged at a lower position of the conveyor belt where a sheet does not pass through.

An image forming apparatus including a cleaning unit requires maintenance of the cleaning unit in order to dispose of adhering substance that has been removed and collected from the conveyor belt.

However, in the above image forming apparatus, because the cleaning unit is arranged below the conveyor belt, it is necessary to remove the conveyor belt during the maintenance of the cleaning unit. Therefore, the maintenance work becomes complicated and time-consuming.

Further, according to an arrangement where the photoconductor drum unit is arranged above the conveyor belt and the cleaning unit is arranged below the conveyor belt, the height of the image forming apparatus is increased and thus the overall size of the image forming apparatus is enlarged.

In view of the foregoing drawbacks, the present invention seeks to provide an image forming apparatus, which can ease the maintenance work of a cleaning unit and which can reduce the overall size of the image forming apparatus.

SUMMARY OF THE INVENTION

According to the present invention, an image forming apparatus comprises: an image forming unit including a plurality of photoconductor drums arranged in tandem; a conveyor belt arranged opposite to the plurality of photoconductor drums and configured to convey a recording sheet; and a cleaning unit including a cleaning member positioned in contact with the conveyor belt and configured to collect substance adhering to the conveyor belt, and a receptacle configured to store the substance collected by the cleaning member, wherein the cleaning member is arranged on the same side as the image forming unit with respect to the conveyor belt and upstream from the image forming unit as viewed in a sheet conveyance direction along which the recording sheet is conveyed on the conveyor belt, and wherein the image forming unit and the cleaning unit are pulled out together from a main body of the image forming apparatus toward an upstream side of the sheet conveyance direction.

According to this image forming apparatus, the cleaning member is arranged on the same side as the image forming unit with respect to the conveyor belt and upstream from the image forming unit as viewed in the sheet conveyance direction, so that the recording sheet passes between the cleaning member and the conveyor belt before an image is transferred onto the recording sheet. Therefore, even with the arrangement where the cleaning member is positioned on the same side as the image forming unit with respect to the conveyor belt, an image can be transferred onto the recording sheet without being soiled by substance adhering to the conveyor belt.

Further, the cleaning member is arranged upstream from the image forming unit as viewed in the sheet conveyance direction, and the image forming unit and the cleaning unit are pulled out together from the main body of the image forming apparatus toward the upstream side of the sheet conveyance direction. Therefore, it is not necessary to pull out the image forming unit completely for the maintenance of the cleaning unit. This can ease the maintenance of the cleaning unit.

Furthermore, because the cleaning member is arranged on the same side as the image forming unit with respect to the conveyor belt, the height of the image forming apparatus can be reduced.

According to the present invention, the maintenance work for the cleaning unit can be readily performed and the overall size of the image forming apparatus can be reduced.

BRIEF DESCRIPTION OF THE DRAWINGS

Other objects and aspects of the present invention will become more apparent by describing in detail illustrative, non-limiting embodiments thereof with reference to the accompanying drawings, in which:

FIGS. 5A and 5B are enlarged sectional views showing main parts of the cleaning unit, in which FIG. 5A shows a rotation of the cleaning roller during an image forming operation, and FIG. 5B shows a rotation of the cleaning roller during a cleaning operation;

DETAILED DESCRIPTION OF THE INVENTION

Preferred embodiments of the present invention will be described in detail with reference to the attached drawings.

Figure 1:
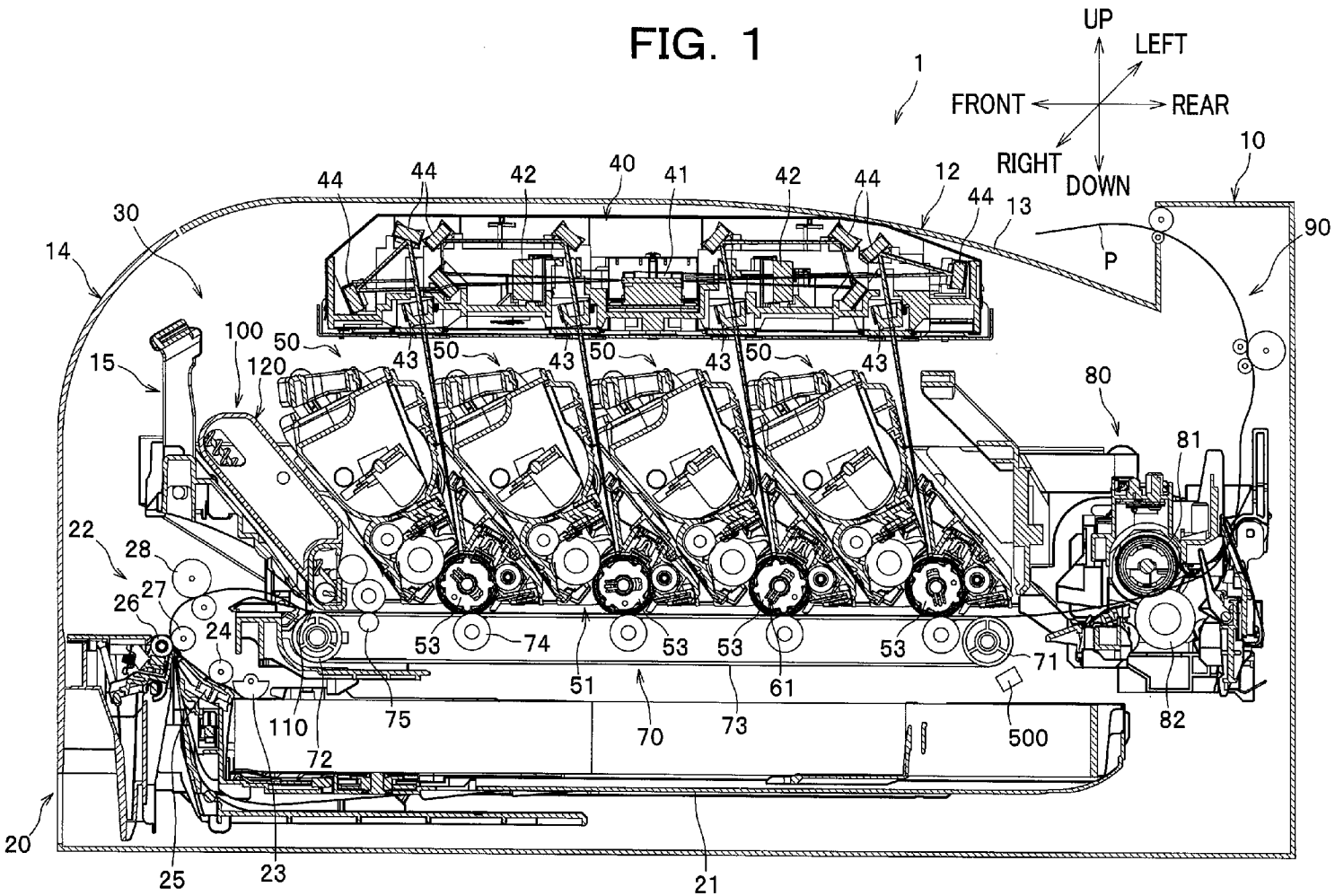
FIG. 1 is a sectional view showing the overall configuration of a color printer as an example of an image forming apparatus according to a first embodiment of the present invention.

In the following description, unless otherwise stated, directions of a color printer refer to the directions as seen from a user facing the color printer during its use. To be more specific, referring to FIG. 1, a left-side direction and a right-side direction of the color printer are referred to as a "front side" and a "rear side", respectively. Also, a direction away from a viewer of FIG. 1 is referred to as a "left side", and a direction toward the viewer of FIG. 1 as a "right side". An upper and lower direction in FIG. 1 is referred to as a "vertical direction" or an "upper and lower direction" as it is.

First Embodiment

As seen in FIG. 1, a color printer 1 has a main body 10. The color printer 1 is provided with a sheet feeding unit 20 configured to feed a sheet of paper P (hereinafter simply referred to as a "sheet" P) as an example of a recording sheet, an image forming device 30 configured to form an image on the sheet P supplied from the sheet feeding unit 20, and a sheet output unit 90 configured to discharge the sheet P having the image thereon from the main body 10, which are arranged in the main body 10.

An upper cover 12 is provided at an upper part of the main body 10. Also, a front cover 14 is provided at a front part of the main body 10. The front cover 14 is pivotally supported on a hinge (not shown) that is provided at a lower part of the main body 10. The front cover 14 is swung in the front-and-rear direction around the hinge (not shown) so as to be opened and closed. The upper surface of the upper cover 12 provides a sheet output tray 13 for receiving and stacking sheets P discharged from the main body 10. A scanner unit 40 is arranged below the upper cover 12.

The sheet feeding unit 20 is arranged at a lower part of the main body 10, and mainly includes a sheet feed tray 21 configured to be attached to or detached from the main body 10, and a sheet feed mechanism 22 configured to convey a sheet P from the sheet feed tray 21 to the image forming device 30. The sheet feed mechanism 22 is positioned in front of the sheet feed tray 21, and mainly includes a feed roller 23, a separation roller 24, and a separation pad 25.

The sheet feeding unit 20 as constructed above separates a stack of sheets P stored in the sheet feed tray 21 and conveys a sheet P on one-by-one basis upwardly toward the image forming device 30, during which the sheet P passes between a paper dust removing roller 26 and a pinch roller 27 to remove paper dust from the sheet P and thereafter the sheet conveyance direction of the sheet P is reversed in the rearward direction past a conveyance roller 28.

The image forming device 30 mainly includes a scanner unit 40, four process cartridges 50 as an example of an image forming unit, a cleaning unit 100, a transfer unit 70, and a fixing unit 80.

The four process cartridges 50 and the cleaning unit 100 are supported together in a drawer frame 15, which is an example of a support member. The drawer frame 15 is configured to be pulled out from the main body 10 with the front cover 14 being opened. The drawer frame 15 is formed, for example, as a bottomless frame and configured to be attached to or detached from the main body 10. As described later, in a state where the drawer frame 15 has been pulled from the main body 10, each of the process cartridges 50 and the cleaning unit 100 is attached to or detached from the drawer frame 15 crossing a pull-out direction along which the drawer frame 15 has been pulled out.

The scanner unit 40 is arranged at an upper part in the main body 10, and includes laser emitting portions (not shown), a polygon mirror 41 that is driven to spin at high speeds, a plurality of lenses 42, 43, and a plurality of reflecting mirrors 44. A laser beam is emitted from the laser emitting portion based on image data. As seen in FIG. 1, the laser beam associated with one of the colors including, for example, cyan, magenta, yellow, and black is reflected by or passes through the polygon mirror 41, the lens 42, the reflecting mirrors 44 associated with the color, and the lens 43 associated with the color in this order. Thereafter, the surface of the photoconductor drum 53 of the corresponding process cartridge 50 is illuminated with the light (i.e., scanned at a high speed)

Figure 2:
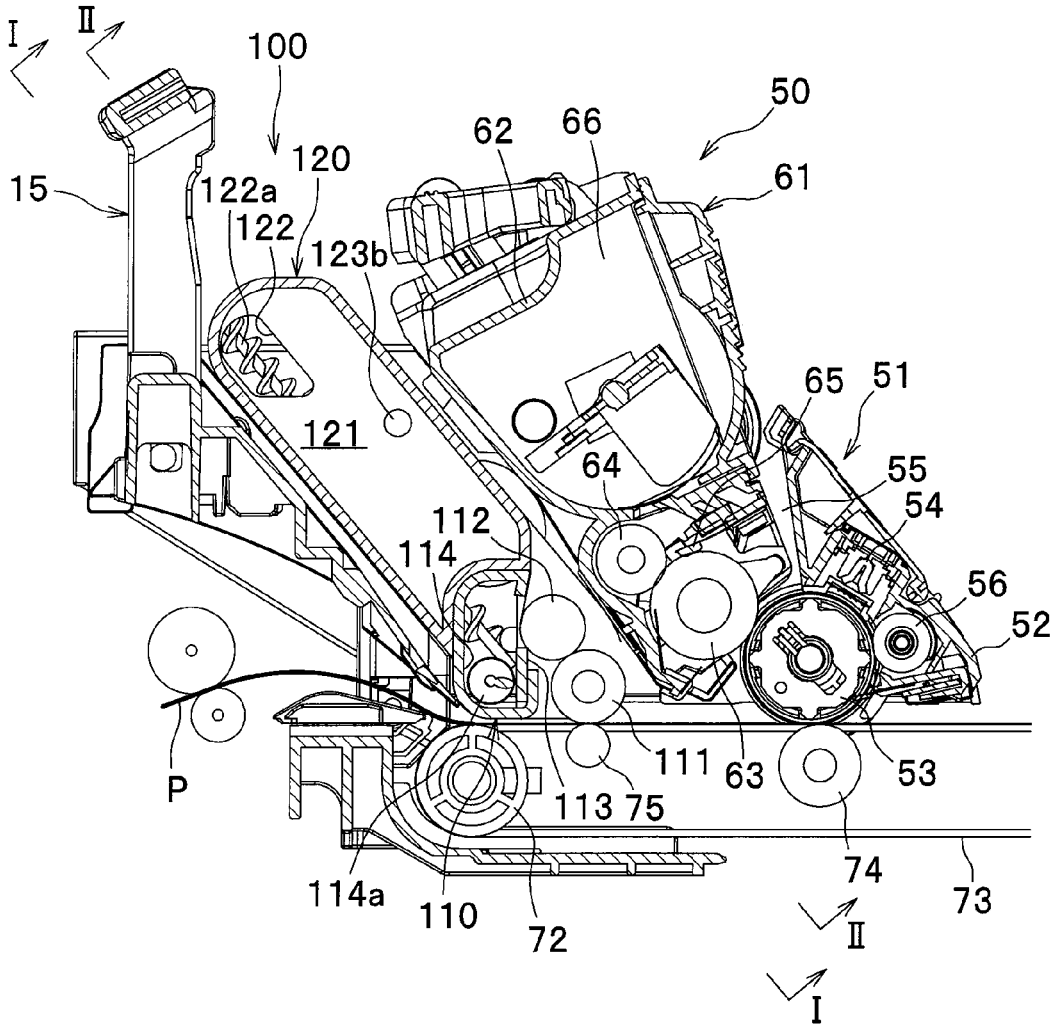
FIG. 2 is an enlarged sectional view showing main parts of a process cartridge and a cleaning unit.

The process cartridges 50 are positioned between the scanner unit 40 and the transfer unit 70 and arranged in line along the front-and-rear direction. As seen in FIG. 2, each of the process cartridges 50 includes a photoconductor cartridge 51, and a developing cartridge 61 as an example of a developer cartridge that is detachably attached to the photoconductor cartridge 51. The process cartridges 50 are detachably mounted to the drawer frame 15.

The photoconductor cartridge 51 mainly includes a drum frame 52, a photoconductor drum 53 rotatably supported on the drum frame 52, a charger 54, and a cleaning roller 56.

The drum frame 52 is configured such that when the developing cartridge 61 is attached to the photoconductor cartridge 51, an exposure opening 55 is defined between the developing cartridge 61 and the photoconductor cartridge 51, through which opening the photoconductor drum 53 can be seen from above. A laser beam coming from the lens 43 of the scanner unit 40 through the exposure opening 55 strikes the surface of the photoconductor drum 53. The cleaning roller 56 is rotatable and positioned in contact with the photoconductor drum 53. When a predetermined electric voltage is applied to the cleaning roller 56, the cleaning roller 56 temporarily collects and retains toner T that has remained on the photoconductor drum 53 after toner T is transferred onto the sheet P.

The developing cartridge 61 includes a developer frame 62, a developing roller 63 and a supply roller 64 rotatably supported on the developer frame 62, a doctor blade 65, and a toner storage chamber 66 for storing toner T.

It is noted that each of the developing cartridges 61 is substantially the same in construction except for the color of toner (developer) T stored in the toner storage chamber 66.

As seen in FIG. 1, the transfer unit 70 is positioned between the sheet feeding unit 20 and the process cartridges 50, and mainly includes a drive roller 71, a driven roller 72, a conveyor belt 73, and transfer rollers 74.

The drive roller 71 and the driven roller 72 are positioned parallel to each other and spaced apart in the front-and-rear direction. The conveyor belt 73 in the form of an endless belt is looped around the drive roller 71 and the driven roller 72. The outer surface of the conveyor belt 73 contacts with the photoconductor drums 53. Four transfer rollers 74 are positioned inside the conveyor belt 73 opposite to the corresponding photoconductor drums 53 with the conveyor belt 73 being interposed therebetween. A transfer bias is applied to each transfer roller 74 by a constant-current control during the transfer of toner T onto the sheet P.

A backup roller 75 is also positioned inside the conveyor belt 73 opposite to a cleaning roller 111 of a cleaning unit 100. The backup roller 75 contacts with the inner side surface of the conveyor belt 73.

The fixing unit 80 is arranged behind the process cartridges 50 and the transfer unit 70. The fixing unit 80 includes a heating roller 81, and a pressure roller 82 positioned opposite to the heating roller 81 and pressing the heating roller 81.

The cleaning unit 100 removes and collects toner T adhering to the conveyor belt 73 as an example of adhering substance. The cleaning unit 100 is arranged on the same side as the plurality of process cartridges 50 with respect to the conveyor belt 73. To be more specific, the conveyor belt 73 is looped around the two rollers 71, 72 so that upper and lower belt regions are defined, and the cleaning unit 100 is arranged above the upper belt region. Further, the cleaning unit 100 is arranged parallel to the plurality of process cartridges 50 and upstream from these process cartridges 50 as viewed in a sheet conveyance direction along which the sheet P is conveyed on the conveyor belt 73. The cleaning unit 100 includes a cleaner portion 110 configured to collect toner T adhering to the conveyor belt 73, and a waste toner box 120 as an example of a receptacle for storing the collected toner T. As with the process cartridges 50, the cleaning unit 100 is also detachably mounted to the drawer frame 15.

Other than paper jamming, toner T often adheres to the conveyor belt 73 during a so-called patch test for testing shading, color tone, and color shift of printed patterns.

As seen in FIGS. 2 and 3, the cleaner portion 110 includes a cleaning roller 111 as an example of a cleaning member, a collecting roller 112, a blade 113, and a carrier unit 114.

The cleaning roller 111 is made of sponge and contacts with the conveyor belt 73 to remove toner T from the conveyor belt 73. To be more specific, the cleaning roller 111 is a conductive foamed roller. The cleaning roller 111 consists of a roller shaft made of metal, and a roller member coating the roller shaft and made of a conductive foamed material such as silicone foam and urethane foam. Because the cleaning roller 111 is made of sponge, even if a large amount of toner T is present on the conveyor belt 73, the toner T can be removed using pores of the sponge.

The collecting roller 112 is made of a hard material such as metal and pressed against the cleaning roller 111. The collecting roller 112 is rotatable and arranged upward and slightly ahead of the cleaning roller 111. The blade 113 is provided at the front of the collecting roller 112. The blade 113 contacts with the collecting roller 112 with a pressure and scrapes toner T off from the surface of the collecting roller 112. The carrier unit 114 defines a passage for carrying the toner T that has been scraped off by the blade 113 to the waster toner box 120. A first auger 114*a* extending in the right-and-left direction is arranged inside the carrier unit 114.

Figure 3A:
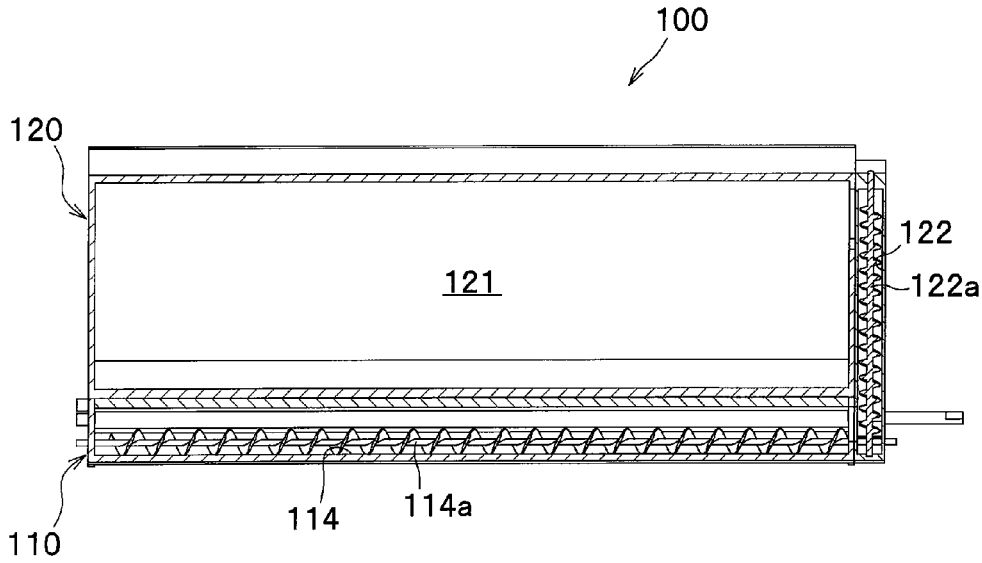
FIG. 3A is a sectional view taken along the line I-I of FIG. 2.

As best seen in FIG. 3A, the waste toner box 120 includes a storage portion 121 for storing collected toner T, and a waste toner loading portion 122 configured to load waste toner T from the cleaner portion 110 into the storage portion 121. The storage portion 121 is substantially in the form of a parallelogram as viewed in a side section, and the lower end of the storage portion 121 is connected to the cleaner portion 110. The waste toner loading portion 122 is a passage for connecting the carrier unit 114 and the storage portion 121. A second auger 122*a* is provided inside the waste toner loading portion 122 and extends diagonally in the vertical direction. The waste toner loading portion 122 is positioned at the left side of the carrier unit 114 and the storage portion 121.

Figure 7:
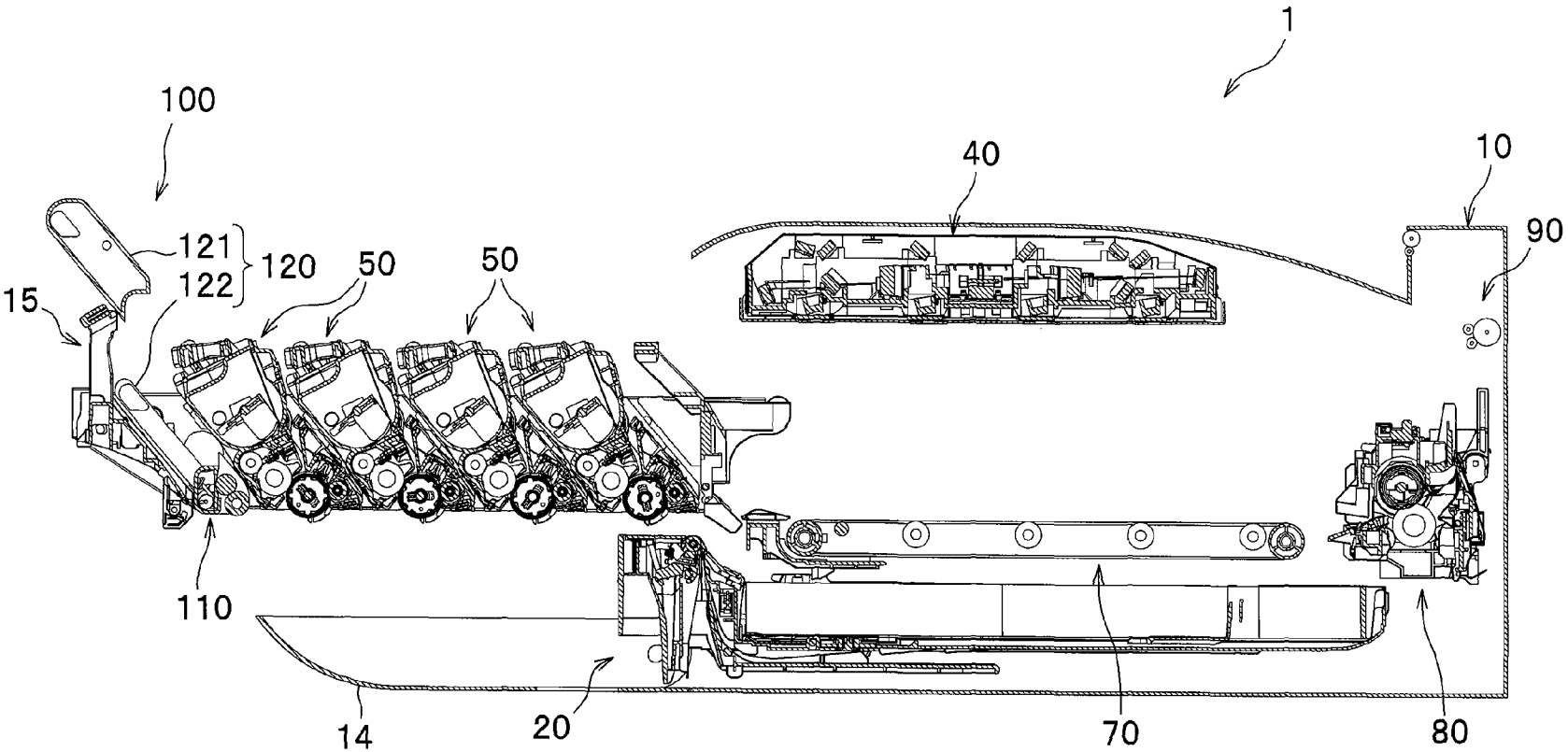
FIG. 7 is a sectional view showing a state in which a waste toner box as an example of a receptacle for storing adhering substance has been removed from the drawer unit.

As best seen in FIG. 7, the storage portion 121 is configured to be separable from the cleaner portion 110 and the waste toner loading portion 122.

Figure 3B:
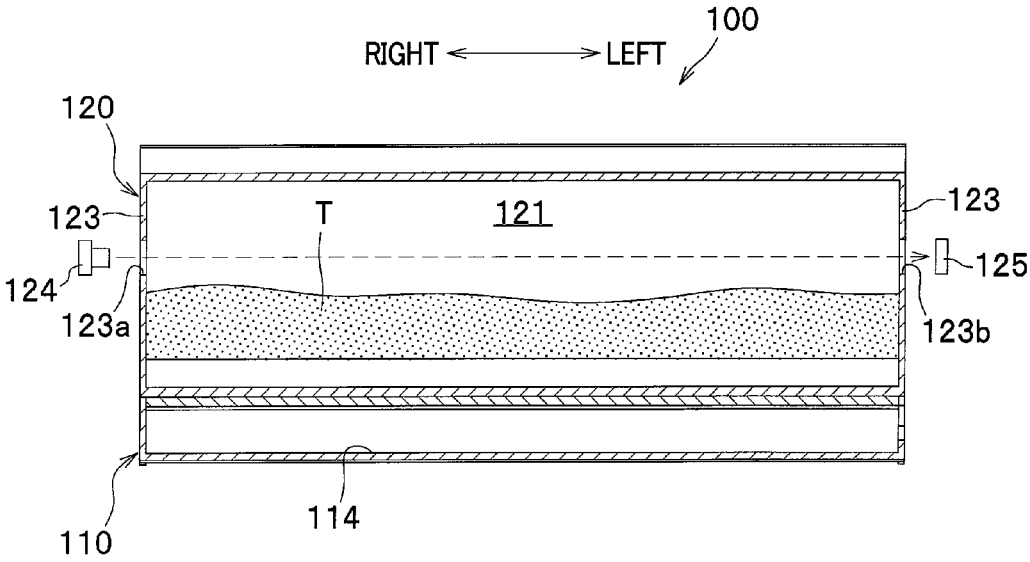
FIG. 3B is a sectional view taken along the line II-II of FIG. 2.

As seen in FIG. 3B, a light emitting portion 124 is provided at the right side of the waste toner box 120 (i.e., left side in FIG. 3B). The light emitting portion 124 emits a light beam for measuring the amount of waste toner T stored in the waste toner box 120. A light receiving portion 125 for receiving the light beam from the light emitting portion 124 is provided at the left side of the waste toner box 120. Light transmission windows 123*a*, 123*b* are formed in the right and left walls 123 of the waste toner box 120, through which windows the light beam from the light emitting portion 124 passes through the waste toner box 120 and received by the light receiving portion 125.

As seen in FIG. 1, a patch pattern sensor 500 is positioned downstream from the process cartridges 50 as viewed in the sheet conveyance direction and opposite to the conveyor belt 73 (e.g., at a position proximate to the drive roller 71). The patch pattern sensor 500 is an example of a detection member for detecting a patch pattern to be transferred onto the conveyor belt 73 during the patch test.

A controller is configured to control a rotating direction of the cleaning roller 111. During a cleaning operation, the controller causes the cleaning roller 111 to rotate in a first direction such that the outer peripheral surface of the cleaning roller 111 and the conveyor belt 73 move in opposite directions at a contacting position where the cleaning roller 111 contacts with the conveyor belt 73. Therefore, the outer peripheral surface of the cleaning roller 111 frictionally contacts with the conveyor belt 73. Meanwhile, during an image forming operation, the controller causes the cleaning roller 111 to rotate in a second direction such that the outer peripheral surface of the cleaning roller 111 and the conveyor belt 73 move in the same direction at the contacting position. In this time, the moving speed of the outer peripheral surface of the cleaning roller 111 is controlled to be equal to that of the conveyor belt 73.

Further, during the patch test for correcting a position shift, the controller controls the cleaning roller 111 based on a detection signal from the patch pattern sensor 500 such that the cleaning roller 111 rotates in the second direction until a patch pattern formed on the conveyor belt 73 reaches a position opposite to the patch pattern sensor 500. The controller then controls the cleaning roller 111 after the patch pattern has passed through the position opposite to the patch pattern sensor 500 such that the cleaning roller 111 rotates in the first direction.

During the patch test for correcting a position shift, the controller determines that the patch pattern has not reached the position opposite to the patch pattern sensor 500 if the patch pattern is not detected by the patch pattern sensor 500. When a predetermined time elapses after the detection of the patch pattern is completed using the patch pattern sensor 500, the controller determines that the patch pattern has passed through the patch pattern sensor 500. Alternatively, the controller may determine that the patch pattern passes through the patch pattern sensor 500 when a predetermined time elapses after the patch pattern is printed.

Figure 4A:
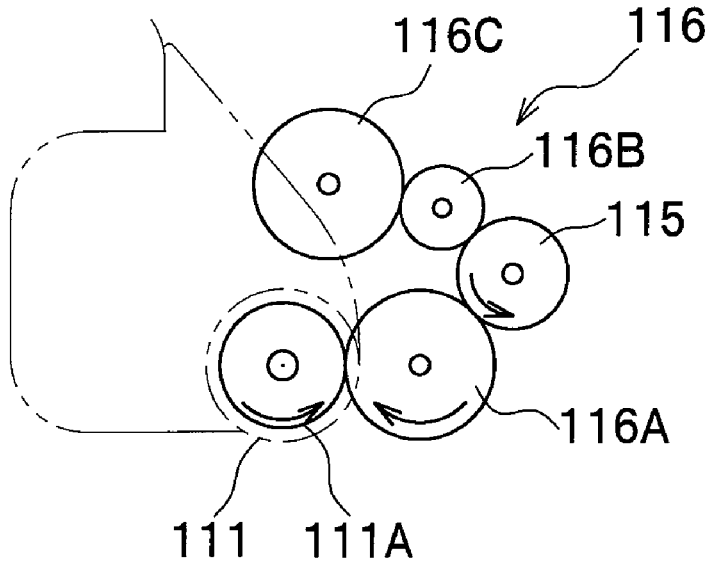
FIGS. 4A and 4B show an example of a gear mechanism for switching a rotating direction of a cleaning roller.
Figure 4B:
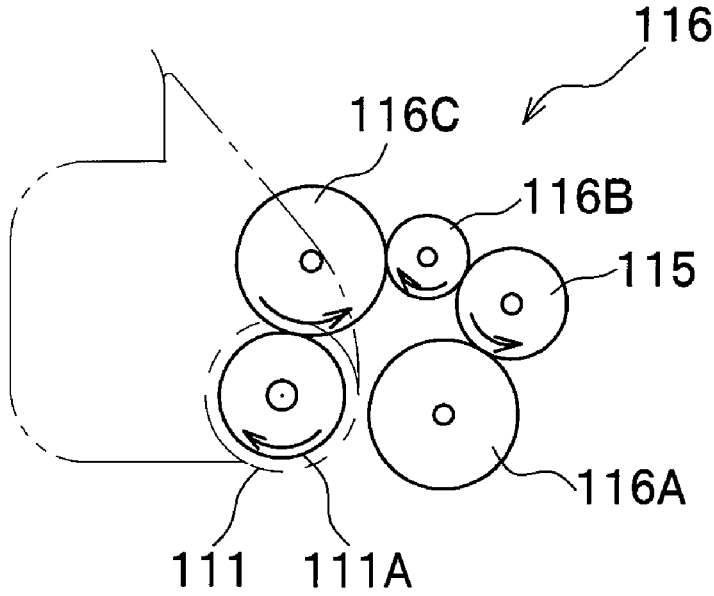
Figure 5A:
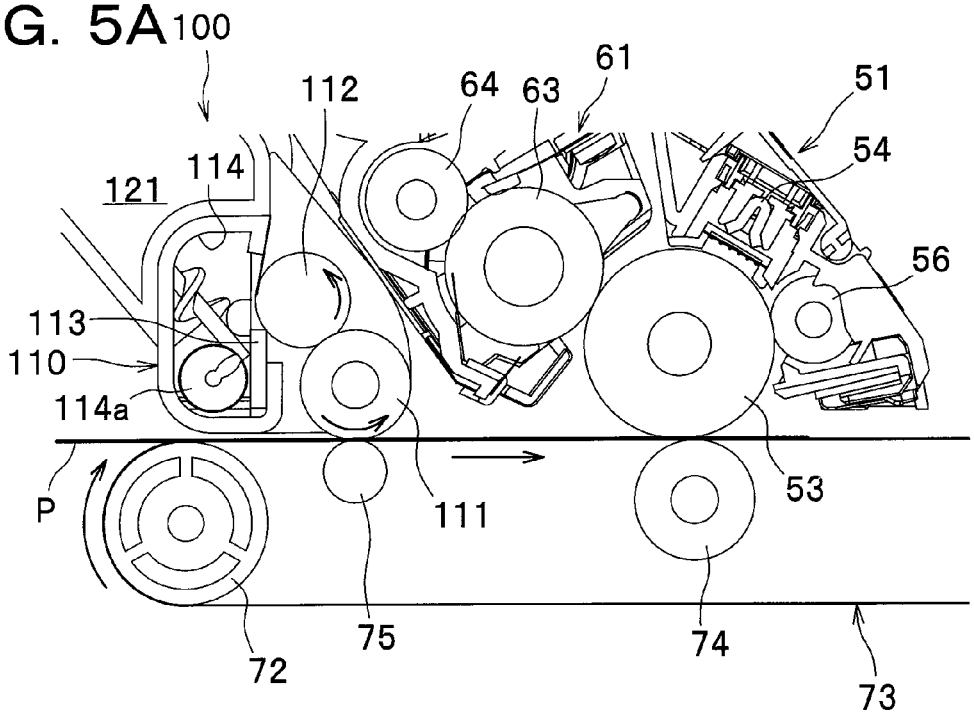
Figure 5B:
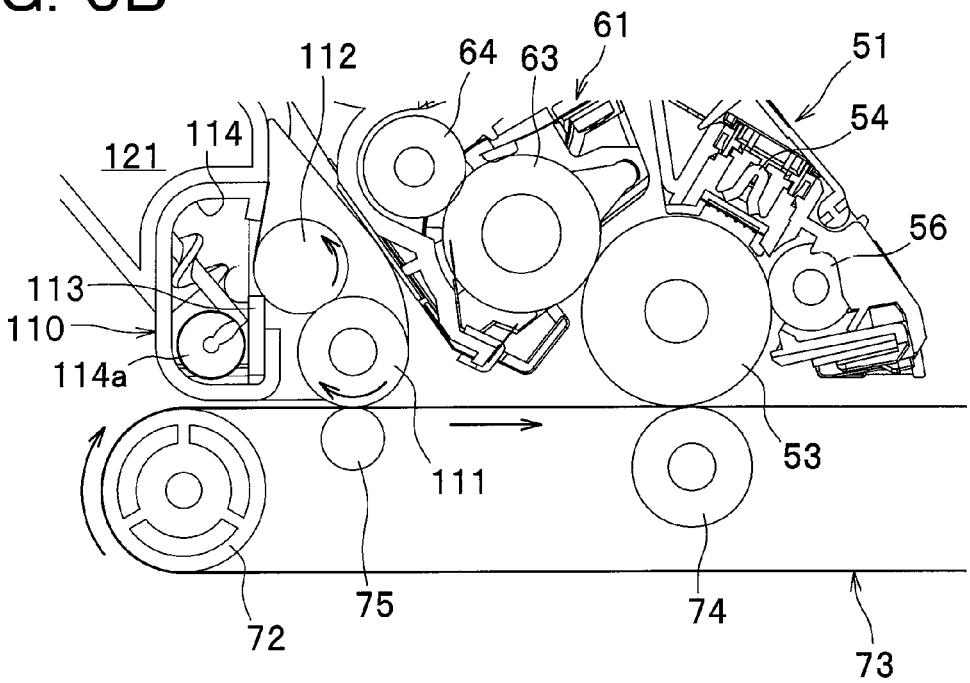

As best seen in FIG. 4A, a switching gear train 116 for switching the rotating direction of the cleaning roller 111 is arranged between the cleaning roller 111 and an actuator 115 for driving the cleaning roller 111, and the controller also actuates the gear train 116. To be more specific, as best seen in FIG. 4A, a rotary driving force of the actuator 115 is transmitted to a cleaning roller gear 11A, which is coaxially provided with the cleaning roller 111, via a gear 116A during the image forming operation. Meanwhile, during the cleaning operation, as best seen in FIG. 4B, the controller causes the switching gear train 116 to rotate around the actuator 115 so that the rotary driving force of the actuator 115 is transmitted to the cleaning roller gear 111A via two gears 116B, 116C. As seen in FIGS. 5A and 5B, the collecting roller 112 rotates in one direction (i.e., anticlockwise direction in FIGS. 5A and 5B), and the rotating direction thereof is unchanged.

According to the image forming unit 30 as constructed above, the surface of each photoconductor drum 53 is positively and uniformly charged by the corresponding charger 54, followed by exposure to a laser beam emitted from the scanner unit 40 in accordance with a subject color of the photoconductor drum 53. Therefore, the electric potential of the exposed area lowers so that an electrostatic latent image associated with image data is formed on the surface of the photoconductor drum 53.

When the supply roller 64 rotates, toner T stored in the toner storage chamber 66 is supplied to the developing roller 63, thereafter by the rotation of the developing roller 63 the toner T moves between the developing roller 63 and the doctor blade 65 at which position the toner T is carried on the developing roller 63 as a thin layer having a constant thickness. It is noted that the toner T carried on the surface of the developing roller 63 is charged positively between the supply roller 64 and the developing roller 63 and also between the developing roller 63 and the doctor blade 65.

The toner T carried on the developing roller 63 moves onto the latent image that is formed on the photoconductor drum 53 when the developing roller 63 opposite to the photoconductor drum 53 contacts with the surface of the photoconductor drum 53. Therefore, the toner T is selectively supplied on the surface of the photoconductor drum 53 to visualize the latent image. A toner image is formed by this reversal process.

Toner images formed on the plurality of photoconductor drums 53 are transferred onto a sheet P while the sheet P is conveyed on the conveyor belt 73 and passes between the photoconductor drums 53 and the transfer rollers 74 that are arranged inside the conveyor belt 73 corresponding to the photoconductor drums 53. When the sheet P passes between the heating roller 81 and the pressure roller 82, the toner images transferred on the sheet P are thermally fixed.

As seen in FIG. 1, the sheet output unit 90 includes plural pairs of conveyance rollers along an output-side sheet conveyance passage and at the discharge opening for sheets P. The sheet P onto which the toner images have been transferred and fixed by heat is conveyed along the output-side sheet conveyance passage by means of the conveyance rollers, discharged from the main body 10, and stacked on the sheet output tray 13.

Operation of the cleaning unit will be described below with reference to FIGS. 5A and 5B.

During the image forming operation such as shown in FIGS. 4A and 5A, the controller outputs an operating signal to the actuator 115, which is engaged with the cleaning roller 111 via the switching gear train 116, so that the cleaning roller 111 rotates in the second direction (i.e., anticlockwise direction in FIG. 5A) such that the cleaning roller 111 and the conveyor belt 73 move in the same direction at a contacting position where the cleaning roller 111 contacts with the conveyor belt 73. Therefore, the sheet P is carried on the conveyor belt 73 and smoothly passes between the cleaning roller 111 and the conveyor belt 73, thereby reaching the photoconductor drum 53. In other words, the cleaning roller 111 does not prevent the conveyance of the sheet P along the conveyor belt 73. For this reason, the cleaning roller 111 can be arranged upstream from the photoconductor drums 53.

During the cleaning operation such as shown in FIGS. 4B and 5B, the controller outputs operating signals to the actuator 115, which is engaged with the cleaning roller 111 via the switching gear train 116, and to a switching gear (not shown) for switching the switching gear train 116, respectively, so that the cleaning roller 111 rotates in the first direction (i.e., clockwise direction in FIG. 5B) such that the cleaning roller 111 and the conveyor belt 73 move in the opposite directions at the contacting position. Therefore, the cleaning roller 111 frictionally contacts with the conveyor belt 73 to remove and collect adhering substance adhering to the conveyor belt 73.

Next, the operation of the cleaning unit will be described for three modes including sheet discharging mode, cleaning mode, and patch pattern measurement mode.

The controller (not shown) transmits an operating signal to the actuator 115, which is engaged with the cleaning roller 111 via the switching gear train 116, at a time when the main power switch of the color printer 1 is turned on or when the front cover 14 is closed after fixing a paper jam or after replacement of various cartridges, so that the cleaning roller 111 rotates in the second direction such that the cleaning roller 111 and the conveyor belt 73 move in the same direction at the contacting position. In this condition, the conveyor belt 73 and other sheet conveyance means are driven for a predetermined period of time. Therefore, even if a sheet P remains in the color printer 1, the sheet P can be discharged from the main body 10 onto the sheet output tray 13. In this instance, because the cleaning roller 111 rotates in the second direction, the cleaning roller 111 does not interfere with the discharge of the sheet P. This series of operations is called as a "sheet discharging mode." The controller (not shown) then transmits operating signals to the actuator (not shown), which is engaged with the cleaning roller 111 via the switching gear train 116, and to the switching gear (not shown), so that the cleaning roller 111 rotates in the first direction. In this condition, the controller causes the conveyor belt 73 to run.

The roller shaft of the backup roller 75 is earthed, and a negative bias is applied to the cleaning roller 111 and a negative bias lower than that applied to the cleaning roller 111 is applied to the collecting roller 112. Therefore, toner T adhering to the conveyor belt 73 moves to the cleaning roller 111 by the action of the bias attraction force and the contacting force of the cleaning roller 111 at around the opposing position of the cleaning roller 111 and the backup roller 75. The toner T carried on the cleaning roller 111 is then moved to the collecting roller 112 by the action of the bias attraction force, and thereafter the toner T carried on the collecting roller 112 is scraped off by the blade 113 and finally supplied into the carrier unit 114. The toner T supplied into the carrier unit 114 is carried to the waste toner loading portion 122 by the first auger 114*a*. The toner T carried to the waste toner loading portion 122 is then supplied into the storage portion 121 by the second auger 122*a* and stored in the storage portion 121.

During this process, a predetermined electric voltage (i.e., a positive bias for moving positively charged toner T toward the photoconductor drum 53) is applied to the cleaning roller 56 provided in the photoconductor cartridge 51 for a predetermined period of time so that the toner T is returned to the photoconductor drum 53. A negative transfer bias is applied to the transfer roller 74 so that the toner T that has been returned to the surface of the photoconductor drum 53 is moved and discharged onto the conveyor belt 73. Thereafter, the toner T moves to the cleaning roller 111 as the conveyor belt 73 turns and is collected by the cleaning roller 111. The collected toner T is stored in the storage portion 121 of the waste toner box 120. Accordingly, removal of the toner T that is temporarily retained by the cleaning roller 56 is completed. This series of operations is called as a "cleaning mode."

Next, the scanner unit 40 forms an electrostatic latent image having a predetermined patch pattern on the surface of the photoconductor drum 53. This latent image is developed using toner T carried on the developing roller 63. The patch pattern developed by the toner T is then transferred on the conveyor belt 73 by applying a negative transfer bias to the transfer roller 74.

When the conveyor belt 73 turns, the resulting patch pattern passes through the patch pattern sensor 500 (see FIG. 1). The patch pattern sensor 500 performs various measurements. The patch pattern sensor 500 is arranged below the driven roller 72 at a position opposite to the driven roller 72 with the conveyor belt 73 interposed therebetween. The patch pattern sensor 500 comprises a light emitting element and a light receiving element, and measures, for example, image density and color shift between respective colors.

The controller controls such that the cleaning roller 111 rotates in the second direction until the patch pattern formed on the conveyor belt 73 passes through the patch pattern sensor 500. Therefore, the cleaning roller 111 does not soil the patch pattern.

At a predetermined time after the patch pattern has completely passed through the position opposite to the patch pattern sensor 500, the cleaning roller 111 rotates in the first direction. Therefore, toner T forming the patch pattern goes around on the conveyor belt 73, and is collected by the cleaning roller 111 and stored in the storage portion 121 of the waste toner box 120. This series of operations is called as a "patch pattern measurement mode."

These three modes of operations including the sheet discharging mode, the cleaning mode, and the patch pattern measurement mode are referred to as a series of start-up operations implemented immediately after turning on the main power switch and immediately after opening and closing the front cover.

As best seen in FIG. 3B, when a measuring beam light emitted from the light emitting portion 124 is blocked by toner T that is stored in the storage portion 121 and not sensed by the light receiving portion 125, the controller (not shown) causes a display device provided on the main body 10 to display a message for encouraging the user to perform maintenance of the cleaning unit 100.

Maintenance of the cleaning unit 100 will be described below with reference to FIGS. 6 and 7.

Figure 6:
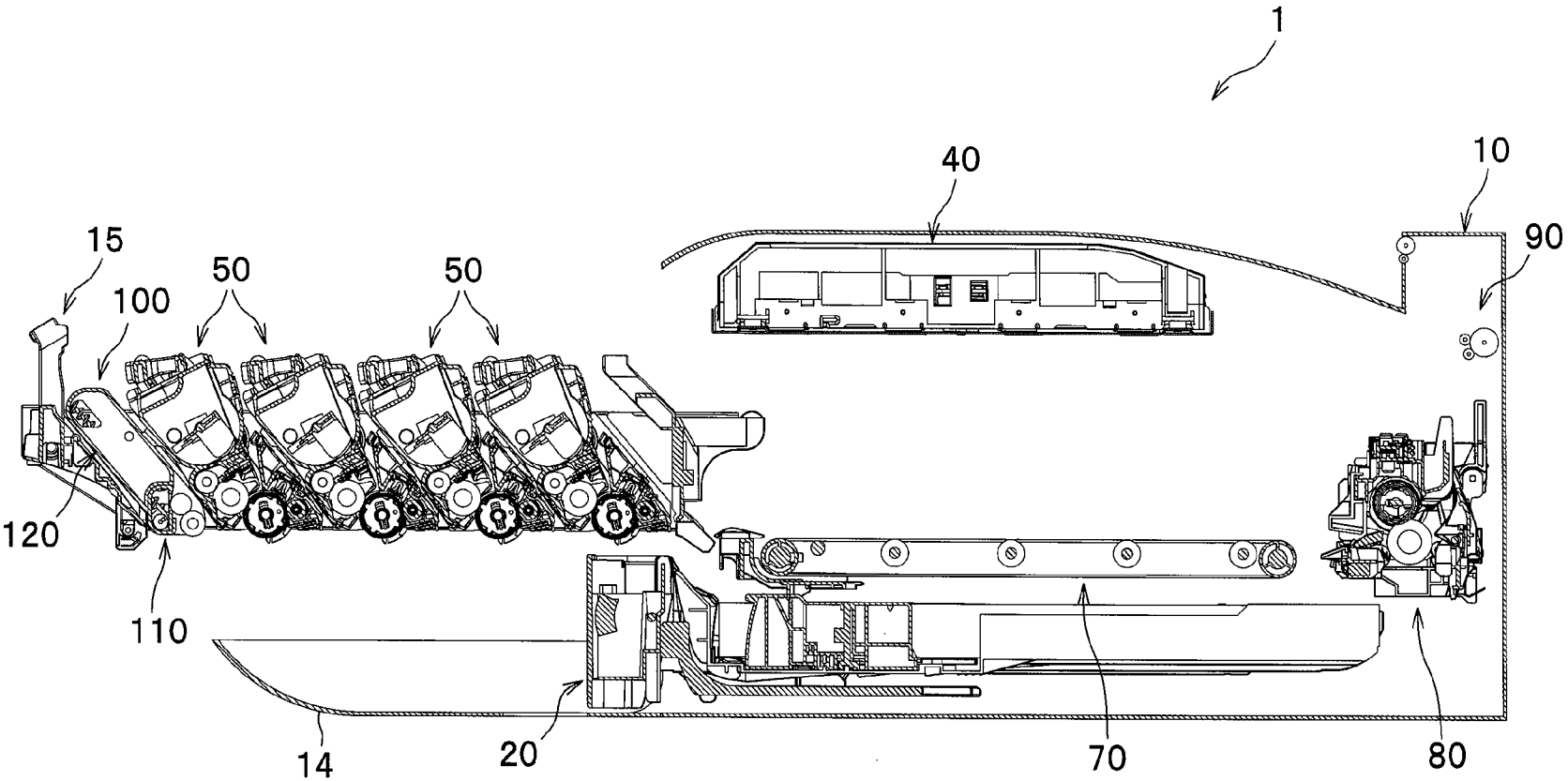
FIG. 6 is a sectional view showing a state in which a drawer unit has been pulled out.

As seen in FIG. 6, when the user performs the maintenance of the cleaning unit 100, the drawer frame 15 is pulled out after the front cover 14 is opened. By this operation, the four process cartridges 50 and the cleaning unit 100 which are mounted to the drawer frame 15 are pulled out from the main body 10 of the color printer 1. Thereafter, as shown in FIG. 7, the cleaning unit 100 is removed from the drawer frame 15 so as to replace it with a new cleaning unit 100 or to dispose of toner T stored in the storage portion 121.

According to the first embodiment, because the box-like storage portion 121 of the cleaning unit 100 is configured to be separable from the cleaner portion 110 and the waste toner loading portion 122, only the storage portion 121 can be removed from the drawer frame 15 while the cleaner portion 110 and the waste toner loading portion 122 are continuously usable. This can reduce time and cost required for the maintenance of the cleaning unit 100.

As with the maintenance of the cleaning unit 100, when the user performs the maintenance of the process cartridge 50, the drawer frame 15 is pulled out after the front cover 14 is opened. Thereafter, the process cartridge 50 is removed from the drawer frame 15 to replace it with a new process cartridge 50.

According to the color printer 1 as constructed above, the maintenance of the cleaning unit 100 can be performed by the same manner of operations as that of the process cartridge 50. In other words, the maintenance of the cleaning unit 100 can be readily performed after a simple operation of pulling out the drawer frame 15 in a direction parallel to the sheet conveyance direction. In this instance, because the cleaning roller 111 is arranged upstream from the process cartridges 50 as viewed in the sheet conveyance direction and the drawer frame 15 is pulled out from the main body 10 of the color printer 1 toward the upstream side of the sheet conveyance direction, it is not necessary to pull out the drawer frame 15 completely for the maintenance of the cleaning unit 100. This can ease the maintenance of the cleaning unit 100.

Further, because the cleaning unit 100 is arranged parallel to the four process cartridges 50, the height of the color printer 1 can be reduced by the height of the cleaning unit 100 compared to the conventional image forming apparatus.

Further, the cleaning unit 100 is configured to be attached to or detached from the drawer frame 15 in an up-and-down direction that is a different direction from a pull-out direction (i.e., upstream direction along the sheet conveyance direction) along which the drawer frame 15 is pulled out from the main body 10. This can prevent the cleaning unit 100 from unintentionally coming off from the drawer frame 15 due to an impact when the drawer frame 15 is pulled out.

During the image forming operation, the controller causes the cleaning roller 111 to rotate in the second direction such that the cleaning roller 111 and the conveyor belt 73 move in the same direction at the contacting position. Therefore, even if the cleaning roller 111 is arranged upstream from the process cartridges 50 as viewed in the sheet conveyance direction, the cleaning roller 111 does not interfere with the conveyance of the sheet P.

Meanwhile, during the cleaning operation, the controller causes the cleaning roller 111 to rotate in the first direction such that the cleaning roller 111 and the conveyor belt 73 move in the opposite directions at the contacting position. Therefore, the cleaning roller 111 frictionally contacts with the conveyor belt 73 to thereby remove substance adhering to the conveyor belt 73 in a reliable manner.

Further, during the patch test, the controller causes the cleaning roller 111 to rotate in the second direction until a patch pattern formed on the conveyor belt 73 reaches the position opposite to the patch pattern sensor 500. Therefore, an unnecessary frictional force does not act on the conveyor belt 73, and measuring the position of the patch pattern can be performed without any adverse affects. This can make it possible to perform the patch test in a reliable manner.

Moreover, during the patch test, the controller causes the cleaning roller 111 to rotate in the first direction after the patch pattern has passed through the position opposite to the patch pattern sensor 500. Therefore, the patch pattern can be deleted without adversely affecting the measurement of the position of the patch pattern.

Second Embodiment

Figure 8:
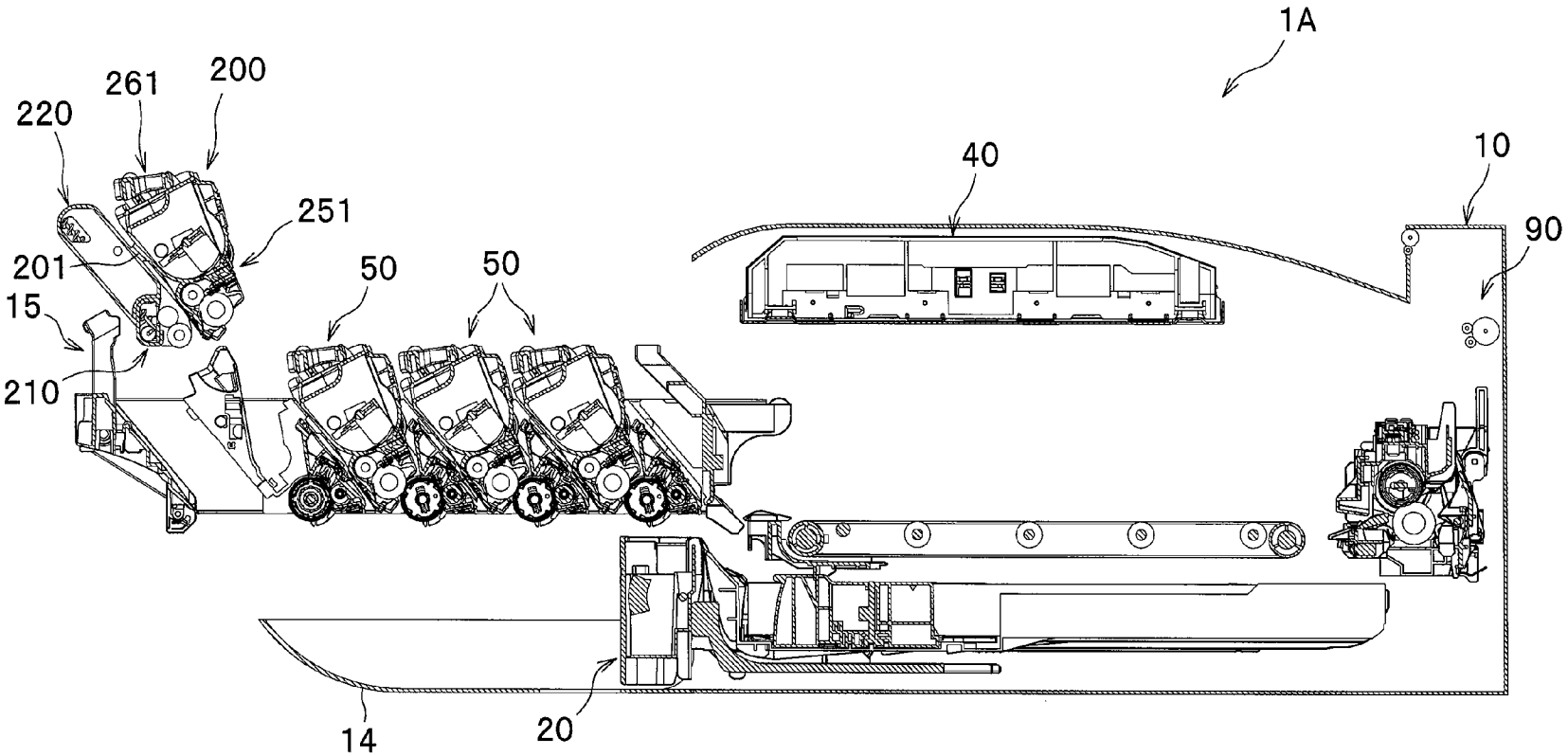
FIG. 8 is a sectional view showing main parts of a color printer according to a second embodiment of the present invention.

A second embodiment of the present invention will be described with reference to FIG. 8. In the following description, parts different from those employed in the first embodiment will be mainly described, and description of like or similar parts will be omitted or briefly stated.

A color printer 1A according to the second embodiment is substantially the same as that of the first embodiment. However, as best seen in FIG. 8, of the four process cartridges 50, 50, 50, 200 arranged tandem in the drawer frame 15, the upstream-most process cartridge 200 positioned at the upstream end along the sheet conveyance direction is different from the corresponding process cartridge 50 according to the first embodiment.

To be more specific, the process cartridge 200 includes a photoconductor cartridge 251, a developing cartridge 261, a cleaner portion 210, and a waste toner box 220. The developing cartridge 261 is integrally formed with the waste toner box 220 through a connecting portion 201. The connecting portion 201 is, for example, a member for connecting a casing of the developing cartridge 261 and a casing of the waste toner box 220. It is noted that the developing cartridge 261 integrally formed with the waste toner box 220 preferably contains black toner T (i.e., a developing cartridge for black toner T).

According to the second embodiment, the waste toner box 220 and the cleaner portion 210 which form a cleaning unit are attached to or detached from the drawer frame 15 together with the developing cartridge 261. Therefore, the maintenance of the cleaning unit is more readily performed. Further, because the waste toner box 220 and the developing cartridge 261 are replaced together, the upper limit of the capacity of the waste toner box 220 can be estimated. This can allow the capacity of the waste toner box 220 to be reduced or this can eliminate the use of means for measuring the amount of toner T in the waste toner box 220.

Figure 9:
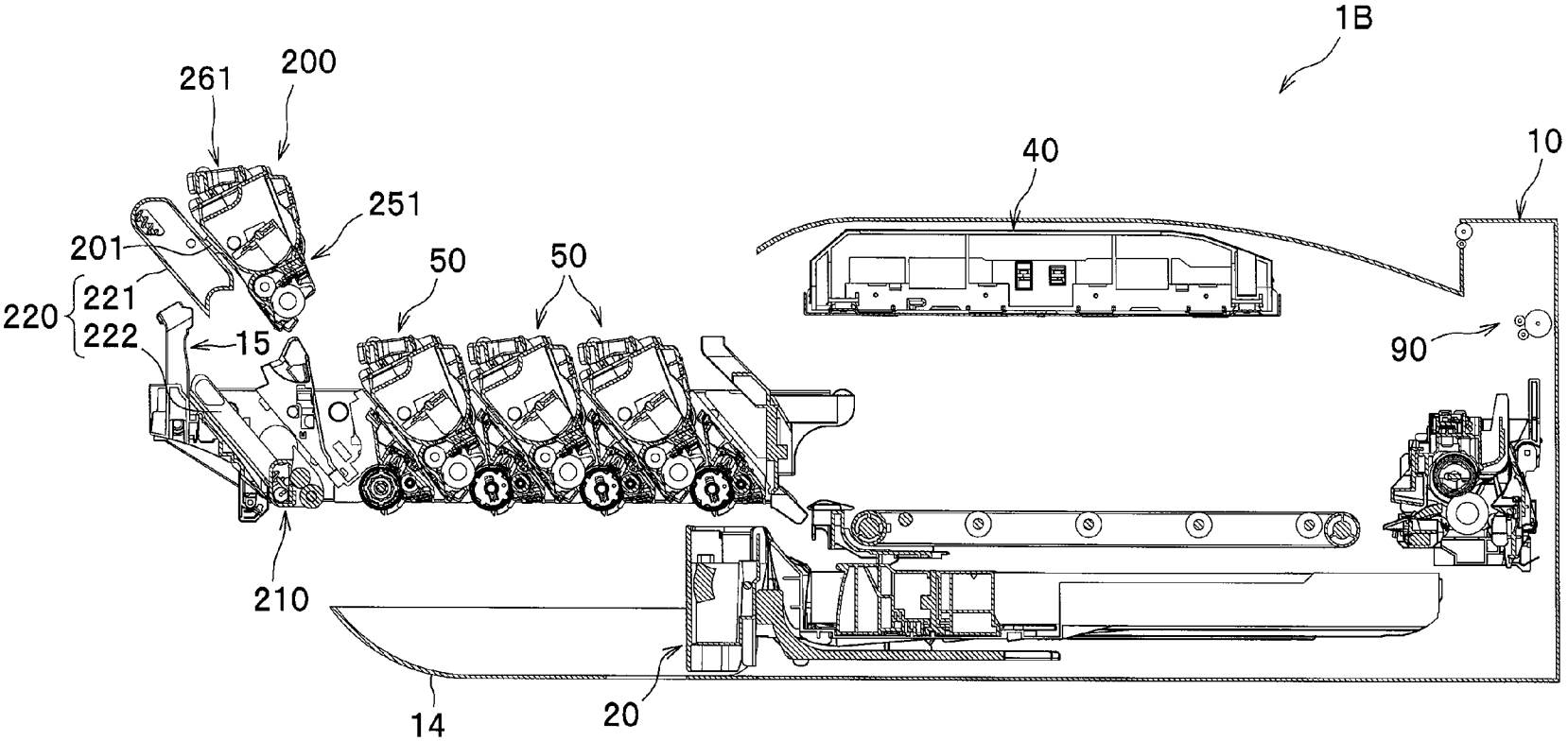
FIG. 9 is a sectional view showing a modification of the color printer according to the second embodiment.

According to a color printer 1B as shown in FIG. 9, which is a modification of the second embodiment, the storage portion 221 and the waste toner loading portion 222, which form the waste toner box 220, are formed such that the storage portion 221 is separable from the cleaner portion 210 and the waste toner loading portion 222 and the storage portion 221 is connected to the developing cartridge 261 through the connecting portion 201. By this configuration, the storage portion 221 can be replaced with a new one for renewing the process cartridge 200 while the cleaner portion 210 and the waste toner loading portion 222 are irreplaceable. This can save the maintenance cost.

Although the present invention has been described in detail with reference to the above embodiments and the accompanying drawings, the present invention is not limited to these specific embodiments and various changes and modifications may be made without departing from the scope of the appended claims.

In the above preferred embodiments, the present invention has been applied to a color printer. However, the present invention is applicable to other image forming apparatuses such as a copying machine and a multifunction device. Further, the present invention is not limited to an image forming apparatus of the type in which an exposure is made using a laser beam, and the present invention is also applicable to an image forming apparatus in which the exposure device uses other light sources such as an LED.

What is claimed is:

1. An image forming apparatus comprising:

an image forming unit including a plurality of photoconductor drums arranged in tandem;

a conveyor belt arranged opposite to the plurality of photoconductor drums and configured to convey a recording sheet between the photoconductor drums and the conveyor belt; and a cleaning unit including a cleaning member positioned in contact with the conveyor belt and configured to collect substance adhering to the conveyor belt, and a receptacle configured to store the substance collected by the cleaning member, wherein the cleaning member is arranged on the same side as the image forming unit with respect to the conveyor belt and upstream from the image forming unit as viewed in a sheet conveyance direction along which the recording sheet is conveyed on the conveyor belt, and wherein the image forming unit and the cleaning unit are pulled out together from a main body of the image forming apparatus toward an upstream side of the sheet conveyance direction.

2. An image forming apparatus according to claim 1, wherein the cleaning member is a rotatable cleaning roller.

3. An image forming apparatus according to claim 2, further comprising a controller configured to control a rotation of the cleaning roller, and during a cleaning operation the controller causes the cleaning roller to rotate in a first direction such that the cleaning roller and the conveyor belt move in opposite directions at a contacting position where the cleaning roller contacts with the conveyor belt and during an image forming operation to rotate in a second direction such that the cleaning roller and the conveyor belt move in the same direction at the contacting position.

4. An image forming apparatus according to claim 3, wherein during a patch test for correcting a position shift, the controller causes the cleaning roller to rotate in the second direction until a patch pattern formed on the conveyor belt reaches a position opposite to a detection member for detecting the patch pattern, and to rotate in the first direction after the patch pattern has passed through the position opposite to the detection member.

5. An image forming apparatus according to claim 2, wherein the cleaning roller is made of sponge.

6. An image forming apparatus according to claim 1, further comprising a support member supporting the image forming unit and the cleaning unit together and configured to be pulled out from the main body, wherein in a state where the support member has been pulled out from the main body, the receptacle is attached to or detached from the support member crossing a pull-out direction along which the support member has been pulled out.

7. An image forming apparatus according to claim 1, further comprising a support member supporting the image forming unit and the cleaning unit together and configured to be pulled out from the main body, wherein in a state where the support member has been pulled out from the main body, the cleaning unit is attached to or detached from the support member crossing a pull-out direction along which the support member has been pulled out.

8. An image forming apparatus according to claim 1, wherein the image forming unit comprises a plurality of developer cartridges each containing developer having a predetermined color, and wherein the receptacle is integrally formed with an adjacent one of the plurality of developer cartridges.

9. An image forming apparatus according to claim 8, wherein the adjacent developer cartridge contains black developer.

10. An image forming apparatus according to claim 8, further comprising a support member supporting the image forming unit and the cleaning unit together and configured to be pulled out from the main body, wherein the cleaning member is fixed to the support member while the receptacle is detachably mounted to the support member.

11. An image forming apparatus according to claim 1, wherein the image forming unit comprises a plurality of developer cartridges each containing developer having a predetermined color, and wherein the cleaning unit is integrally formed with an adjacent one of the plurality of developer cartridges.

12. An image forming apparatus according to claim 11, wherein the adjacent developer cartridge contains black developer.

* * * * *